US011092396B1

(12) United States Patent
Sugg

(10) Patent No.: US 11,092,396 B1
(45) Date of Patent: Aug. 17, 2021

(54) BARREL EXTENSION AND FURTHER IMPROVEMENTS

(71) Applicant: Edward Sugg, South Riding, VA (US)

(72) Inventor: Edward Sugg, South Riding, VA (US)

( * ) Notice: Subject to any disclaimer, the term of this patent is extended or adjusted under 35 U.S.C. 154(b) by 0 days.

(21) Appl. No.: 16/859,866

(22) Filed: Apr. 27, 2020

Related U.S. Application Data

(60) Provisional application No. 62/838,807, filed on Apr. 25, 2019.

(51) Int. Cl.
*F41A 9/55* (2006.01)
*F41A 3/30* (2006.01)
*F41A 21/48* (2006.01)

(52) U.S. Cl.
CPC *F41A 3/30* (2013.01); *F41A 9/55* (2013.01); *F41A 21/481* (2013.01); *F41A 21/482* (2013.01)

(58) Field of Classification Search
CPC ..... F41A 3/30; F41A 9/55
USPC ..... 42/75.02
See application file for complete search history.

(56) References Cited

U.S. PATENT DOCUMENTS 9,038,525 B2 5/2015 Sullivan et al.
9,057,576 B2 * 6/2015 Barrett ..... F41A 21/481
9,347,719 B1 * 5/2016 Stone ..... F41C 23/18
9,448,020 B1 * 9/2016 Olson ..... F41A 3/66
9,658,020 B2 * 5/2017 Daniel ..... F41C 23/16
9,885,529 B2 2/2018 Lewis
10,488,128 B2 11/2019 Leitner-Wise
10,739,096 B2 * 8/2020 DeSomma ..... F41A 3/16

OTHER PUBLICATIONS

"Bolt Rings Damaged?", https://www.ar15.com/forums/ar-15/Bolt_rings_damaged_/118-652490/, entry #4 from AR-4C, 9 Pages Total, (Year: 2014).

(Continued)

*Primary Examiner* — Reginald S Tillman, Jr.
(74) *Attorney, Agent, or Firm* — Arent Fox LLP

(57) ABSTRACT

A barrel extension usable with a firearm and a firearm having a barrel extension is disclosed. The barrel extension may include a barrel extension body extending along a barrel extension central axis between a barrel interface end. The barrel interface end may be configured to be connected to a barrel and the bolt receiving end may be configured to selectively receive a rotatable bolt of the firearm. The barrel extension may further include a plurality of barrel extension lugs at the bolt receiving end having bolt lug receiving openings therebetween, wherein each of the plurality of barrel extension lugs has a lug inner surface that is a first distance from the central axis, and each of the plurality of receiving openings have a receiving opening inner surface that is a second distance from the central axis. The barrel extension further includes a first feed ramp with a first feed ramp surface configured to guide a firearm cartridge, a second feed ramp with a second feed ramp surface configured to guide a firearm cartridge, and a ramp divider between the first feed ramp and the second feed ramp, wherein the ramp divider has a ramp divider inner surface that is a third distance from the central axis.

19 Claims, 7 Drawing Sheets

(56) References Cited

OTHER PUBLICATIONS ar15.com, AR-15 » Build It Yourself, [Archived Thread]-Feeding issues, johnnyrotton0639, Posted: Nov. 25, 2015 8:16:41 PM EDT, ar15.com LLC. Retrieved from URL: https://www.ar15.com/forums/ar-15/Feeding_issues/4-684772/,(6 Pages Total), Retrieved on Apr. 27, 2020.

Firearms Forum, Inc., The Highroad, Show me your .308 AR feed-ramps, Discussion in 'Rifle Country' started by ColoradoMinuteMan, Jan 5, 2017., Retrieved from URL: https://www.thehighroad.org/index.php?threads/show-me-your-308-ar-feed-ramps.815851/, (13 Pages Total), Retrieved on Apr. 27, 2020.

Pinterest, Inc., Tactical Life, AR feed ramps and barrel extensions, Retrieved from URL: https://www.pinterest.com/pin/382665299574062994/, (9 Pages Total),Retrieved on Apr. 27, 2020.

* cited by examiner

BARREL EXTENSION AND FURTHER IMPROVEMENTS

CLAIM TO PRIORITY AND RELATED APPLICATIONS

This application claims priority to applicant's U.S. Provisional Application No. 62/838,807 filed on Apr. 25, 2019, titled "Barrel Extension Improvements and Optimization," U.S. patent application Ser. No. 15/732,225 filed on Oct. 6, 2017, titled "Operating System Improvements," U.S. patent application Ser. No. 15/732,671 filed on Dec. 12, 2017, titled "Firearm Bolt," and U.S. patent application Ser. No. 15/932,484 filed on Mar. 6, 2018, titled "Further Improvements—Firearms and Weapons Systems," which are all incorporated herein by reference in their entirety.

FIELD

This disclosure relates generally to firearms, and more particularly to a barrel extension usable with a firearm.

SUMMARY

The following aspects and aspects thereof are described and illustrated in conjunction with systems, tools and methods which are meant to serve as examples and be illustrative, not limiting in scope.

This disclosure provides improvements and enhancements to firearms. One example of firearms that are usable with and may be improved by aspects outline in the current disclosure are those that follow the "Stoner Pattern" such as the M4/M16/AR15 and similar related firearms whether they are Direct Impingement (Dl) or Piston operated and regardless of caliber. This includes AR10/SR25 and M110 class as well as others, such as the HK 416 and 417, and other firearms that use a similar multiple lug rotating bolt with a mating barrel extension, which the Bolt "locks" into for firing and unlocks from for extraction and ejection. The hardened steel Barrel Extension permits the use of lighter and/or lower strength receiver materials, such as aluminum and polymer, to name a few examples. This helps make the weapon or firearm lighter and/or less expensive. among other advantages. These improvements apply to other multi lug rotating bolt weapons and firearms as well. These concepts should be considered to apply without limitation wherever applicable. In one aspect, the disclosed barrel extension may be usable with a to 5.56 mm/.223 caliber firearm, but may also be adjusted or scaled in dimension(s) commensurately where applicable—e.g., given ranges or numbers should be considered as a relative percentage and vice versa, and all improvements should be considered disclosed for use with any applicable caliber and adjusted accordingly.

In one aspect, a barrel extension usable with a firearm is disclosed. The barrel extension may include a barrel extension body extending along a barrel extension central axis between a barrel interface end and bolt receiving end opposite the barrel interface end. The barrel interface end may be configured to be connected to a barrel, and the bolt receiving end may be configured to selectively receive a rotatable bolt of the firearm. The barrel extension may further include a plurality of barrel extension lugs at the bolt receiving end having bolt lug receiving openings therebetween, wherein each of the plurality of barrel extension lugs has a lug inner surface that is a first distance from the central axis, and each of the plurality of receiving openings have a receiving opening inner surface that is a second distance from the central axis. The barrel extension may further include a first feed ramp with a first feed ramp surface configured to guide a firearm cartridge, a second feed ramp with a second feed ramp surface configured to guide a firearm cartridge, and a ramp divider between the first feed ramp and the second feed ramp, wherein the ramp divider has a ramp divider inner surface that is a third distance from the central axis. In one aspect the first distance, second distance, and/or third distance may be substantially the same. In another aspect, if the first distance is R1, the second distance is R2, and the third distance R3, the inequality R1<R3<R2 is satisfied.

In one aspect, a barrel extension usable with a firearm is disclosed, the barrel extension including a barrel extension body having a radial outer surface and extending along a barrel extension central axis between a barrel interface end and a bolt receiving end, wherein the barrel interface end is configured to be connected to a barrel and the bolt receiving end is configured to selectively receive a rotatable bolt of the firearm. The barrel extension further includes a plurality of barrel extension lugs at the bolt receiving end having bolt lug receiving openings therebetween. The barrel extension further includes a first feed ramp with a first feed ramp surface configured to guide a firearm cartridge, a second feed ramp with a second feed ramp surface configured to guide a firearm cartridge, and an angled ramp divider between the first feed ramp and the second feed ramp having a ramp divider surface, wherein at least a portion of the ramp divider surface meets the outer radial surface at a ramp divider edge, and wherein the at least a portion of the ramp divider is oblique with respect to the radial outer surface at the edge. Additional advantages and novel features of these aspects will be set forth in part in the description that follows, and in part will become more apparent to those skilled in the art upon examination of the following or upon learning by practice of the disclosure.

BRIEF DESCRIPTION OF THE DRAWINGS

Example aspects are illustrated in the drawings. It is intended that the aspects and figures disclosed herein are to be considered illustrative rather than restrictive.

In the drawings.

DETAILED DESCRIPTION

In the following detailed description, reference is made to the accompanying Figures, which form a part thereof. In the Figures, similar symbols typically identify similar components, unless context dictates otherwise. The illustrative aspects described in the detailed description, Figures, and claims are not meant to be limiting. Other aspects may be utilized, and other changes may be made, without departing from the spirit or scope of the subject matter presented herein. It will be readily understood that the aspects of the present disclosure, as generally described herein, and illustrated in the Figures, can be arranged, substituted, combined, separated, and designed in a wide variety of different configurations, all of which are explicitly contemplated herein.

The following includes definitions of selected terms employed herein. The definitions include various examples and/or forms of components that fall within the scope of a term and that may be used for implementation. The examples are not intended to be limiting. Further, it will be obvious to one skilled in the art that the present invention may be practiced without these specific details. In other instances, well-known methods, procedures, and components have not been described in detail so as to not unnecessarily obscure aspects of the present invention.

Throughout the disclosure, the term substantially or approximately or about may be used as a modifier for a geometric quantity, relationship between elements and/or for the shape of an element or component. While the terms substantially, approximately and/or about are not limited to a specific variation and may cover any variation that is understood by one of ordinary skill in the art to be an acceptable variation, some examples are provided as follows. In one example, the terms substantially, approximately, or about may include a variation of less than 10% of the dimension of the object or component. In another example, the terms substantially, approximately and/or about may include a variation of less than 5% of the object or component. If the terms substantially, approximately, and/or about are used to define the angular relationship of one element to another element, one non-limiting example of the terms may include a variation of 5 degrees or less. These examples are not intended to be limiting and may be increased or decreased based on the understanding of acceptable limits to one of ordinary skill in the art.

For purposes of the disclosure, directional terms are expressed generally with relation to a standard frame of reference when the firearm or aspects thereof described herein are in an in-use orientation.

Figure 1:
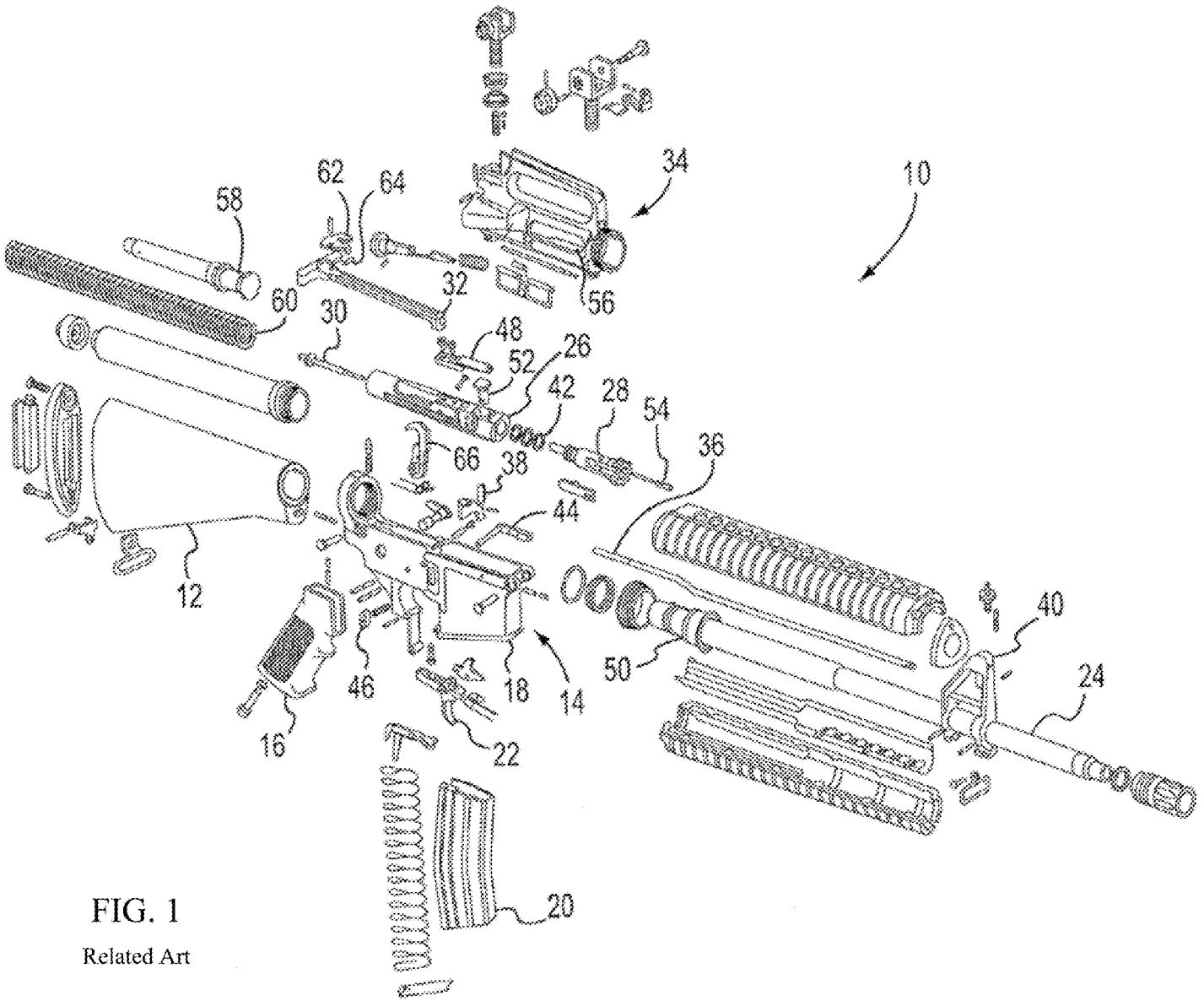
FIG. 1 Related Art
FIG. 1 shows an exploded view of an example firearm usable with aspects of the current disclosure.

FIG. 1 shows an exploded view of a firearm, which serves as an example of a firearm to which the inventive improvements disclosed herein may be applied. As shown in FIG. 1, the firearm 10 may include, among other elements, a buttstock 12, a lower receiver 14, a handle 16, a magazine well 18, a magazine 20, a trigger 22, a barrel 24, a bolt carrier 26, a bolt 28, a firing pin 30, a charging handle 32, an upper receiver 34, a gas tube 36, a bolt catch 38, a sight 40, gas rings 42, a magazine catch 44, and a magazine release button 46.

During operation of the firearm shown in FIG. 1, gas travels down the gas tube 36, which is located above the barrel 24. The gas tube 36 protrudes into a bolt carrier key 48 which allows the gas to into the bolt carrier 26. The bolt 28 and bolt carrier 26 together act as a piston, which moves as the bolt carrier 26 is filled with gas. The bolt 28 is incapable of movement because it is locked to barrel extension 50. Therefore, when the bolt carrier 26 is filled with gas, the bolt carrier 26 is forced backward, toward the buttstock 12. A cam pin 52, riding in a slot on the bolt carrier 26, forces the bolt 28 to turn and unlock from the barrel extension 50. Once the bolt 28 is unlocked, the bolt 28 moves rearward along with the bolt carrier 26, The rearward motion of the bolt 28 extracts an empty cartridge case from the chamber, and a spring-loaded ejector 54 forces the cartridge out the ejection port 56. Behind the bolt carrier is a plastic or metal buffer 58 which rests in line with a return spring 60 that pushes the bolt carrier 26 back toward the chamber. A groove of the upper receiver traps the cam pin 52 and prevents it and the bolt 28 from rotating into a closed position. The locking lugs of the bolt 28 then push a new round from the magazine, which is guided by feed ramps into the chamber. As the bolt's locking lugs move past the barrel extension, the cam pin is allowed to twist into a pocket milled into the upper receiver. This twisting action follows the groove cut into the carrier and forces the bolt to twist and "lock" into the barrel extension 50. Thus, among other functions, the barrel extension 50 serves three purposes; first, the barrel extension engages and disengages with the bolt 28 during the firing sequence to ensure that the gasses created when a cartridge is fired primarily expand through barrel 24; second, the barrel extension disengages from the bolt to allow the expended cartridge to be expelled from the firearm; third, the barrel extension 50 includes feed ramps (discussed in further detail below) that assist with the feeding of a new cartridge into the barrel 24.

Barrel Extension

Figure 2:
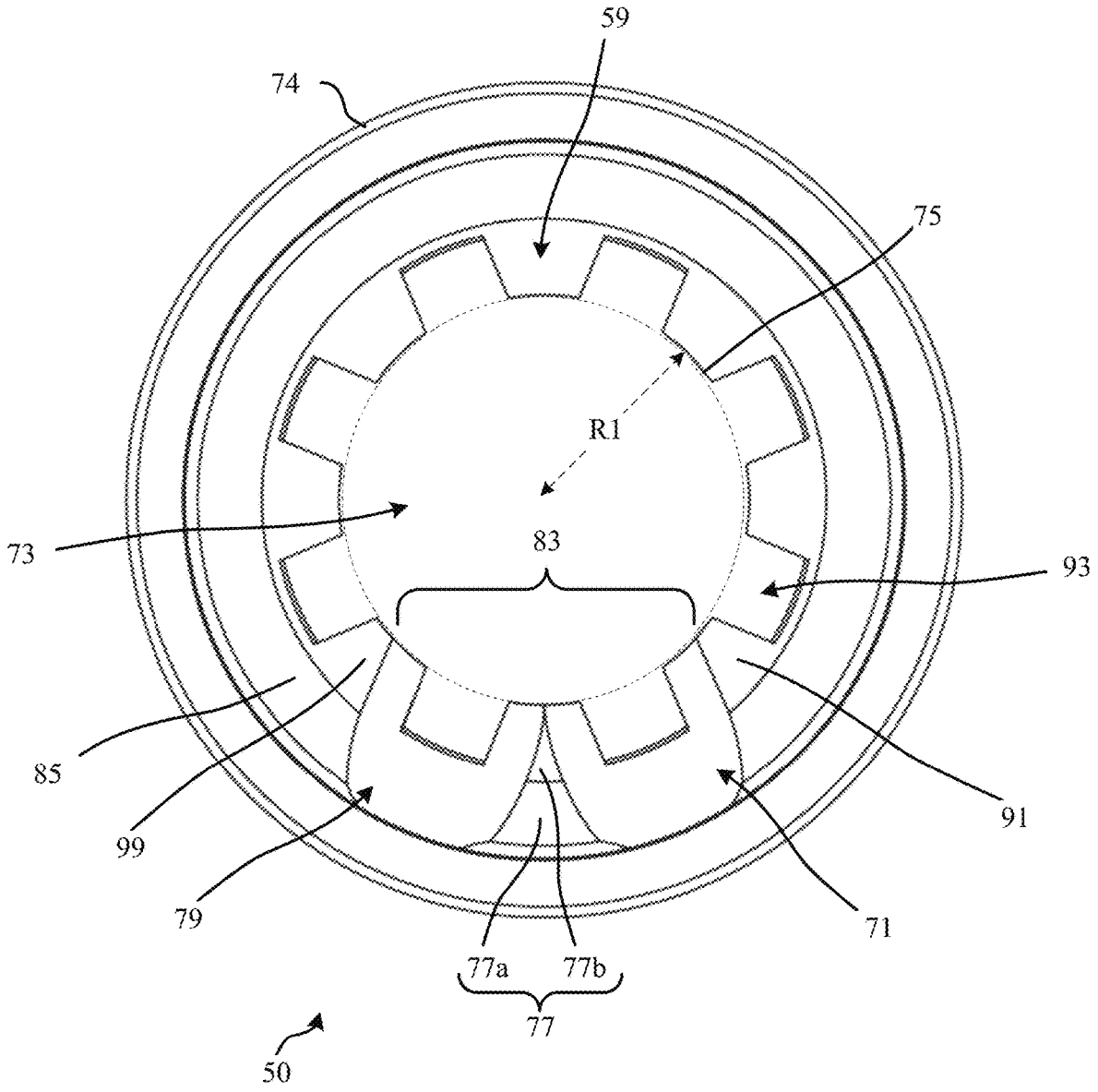
FIG. 2 Related Art
FIG. 2 is a rear view of a related art barrel extension.
Figure 3:
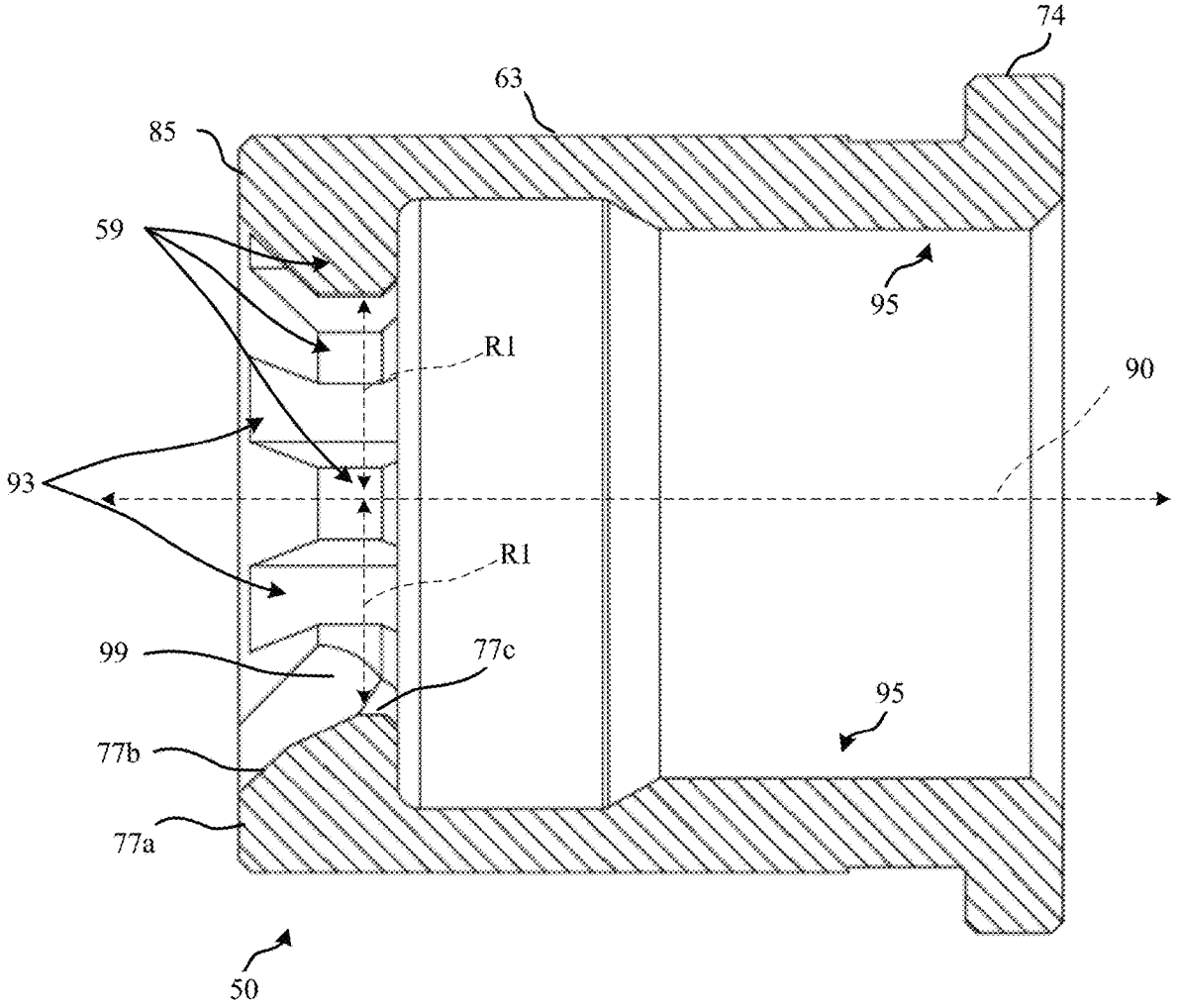
FIG. 3 Related Art
FIG. 3 is a right side section view of the related art barrel extension of FIG. 2.

FIGS. 2 and 3 show a related art barrel extension. The following explanation serves as an overview to assist with understanding of the novel features of the disclosure, no portion of the overview or specification is intended to be limiting; further explanation of the features of the disclosure are described in detail below.

When the M4 platform was first introduced, decades after the introduction of the M16, the barrel extension, which may hereinafter be interchangeably referred to as BBL EXT, was changed in order to provide greater reliability with a shorter barrel (the M16 had 20" barrel whereas the M4 has a 14.5" barrel) and gas system (rifle system on M16 and carbine system on the M4). FIGS. 1 and 2 show a rear view and a right side section view, respectively, of an M4 barrel extension 50. The barrel extension 50 includes feed ramps 71 and 79 for feeding cartridges into a barrel extension passage 73, which when connected to a barrel (e.g., barrel 24 in FIG. 1) is in communication with the barrel. During operation, a cartridge is passed thought the barrel extension passage 73 and into the barrel (e.g., barrel 24 in FIG. 1), which may be interchangeably referred to as a chamber; the movement of a cartridge into the barrel may be referred to as chambering a round. When developing the M4 platform, the feed ramps were extended into the upper receiver but the feed ramps were made steeper in angle and thus the chambering of a cartridge requires an abrupt "climb" of the cartridge from the magazine to the chamber. The feed ramp angle had been 45 degrees in the M16 series but was changed to 52 degrees for the M4 series.

The barrel extension (e.g., 50 in FIGS. 2 and 3 and 100 in FIGS. 4-7) serves as a transition point between the feed device (typically a detachable box magazine, such magazine 20 in FIG. 1, which holds the cartridges) and the chamber of the barrel (e.g. barrel 24 in FIG. 1). The cartridge is fed through the barrel extension, so the current inventor noted that a properly designed and optimized barrel extension, in contrast to the related art of FIGS. 2 and 3, is crucial to maximizing performance and reliability of a firearm or weapon. While the M16 has had little improvement in the barrel extension since inception in the early 1960's, the Inventor noted that the M4 barrel extension lacks efficiency due at least partially to the increased steepness of the feed ramps (which the cartridges move on from the magazine etc., to the chamber) from the original M16 steepness of 45 degrees to even steeper 52 degrees in the M4.

Amongst other improvements contained herein, changing the feed ramp geometry so that a feed ramp angle is less than 52 degrees in the M4 barrel extension while still maintaining complete compatibility is disclosed. Additionally, a barrel extension in accordance with the current disclosure may have a radial outer surface that extends along a first axis and may have a first feed ramp and/or a second feed ramp that forms an angle of 44 degrees or less with respect to the first axis.

In one aspect, a barrel extension having a first and/or second feed ramp is disclosed, and the contact surfaces of the barrel extension (e.g., surface that a cartridge may contact during feeding and/or withdrawal of the cartridge) may be improved to provide a smooth and non-disruptive surface for guiding a cartridge. The barrel extension in accordance with the current disclosure may provide improved efficiency and reliability at least because a cartridge case is usually made of soft, fairly malleable brass that can easily be caught or deformed on rough or irregular surfaces, which in turn may cause stoppages or jams. Further, the bullet (e.g., projectile portion of the cartridge) may also be formed of a soft core and/or copper jacket, and thus the disclosed barrel extension may reduce or eliminate occurrences of deformation of the bullet prior to firing; this aspect may be particularly advantageous when "match" ammunition (typically heavier weight, precision made boat tail hollow points), is used for high firing accuracy. Further, aspects of the disclosure related to improvement of the feeding of cartridge via the barrel extension may also be especially advantageous for the use of more recent service ammunition with a copper slug and a steel and/or hardened steel penetrator (e.g., M855A1 ("A1") in 5.56 mm and M80A1 in 7.62 mm NATO), and aspects of the current disclosure allow for cartridges to be fed into the chamber by the barrel extension at an angle that is as in-line with the bore of the barrel (e.g., barrel 24 in FIG. 1) as possible, which helps to prevent contact between the steel penetrator and the chamber; thus, aspects of the current disclosure provide the advantage (among others) of decreasing or eliminating the occurrence of gouges to the chamber caused by contact between the steel penetrator of a bullet and the barrel, especially at a section near or chamber.

The advantages mentioned above, along with additional advantages, may be provided by the disclosed features. For example, aspects of the current disclosure relate to a barrel extension with blended, softened, chamfered and/or radiused edges—beyond that found in the technical data package ("TDP") defining M16 and M4 dimensions. By providing any one or a combination of blended, softened, chamfered and/or radiused edges, especially at the section of the barrel extension that is used to feed or otherwise guide cartridges, the occurrence of undesired contact or deflection between the cartridge and barrel extension may be reduced or eliminated. Further, aspects of the current disclosure may also include an improved material finish of the barrel extension and/or use of a metal with improved properties and/or with a coating and/or multiple coatings to further enhance performance and reliability.

The aspects discussed below are also applicable to and provide advantages for cartridges used in the 0.223 Remington/5.56 mm class, for example, but may be even more useful in the case of larger projectiles such as the 0.300 Blackout ("BLK") cartridge and the 6.8 mm special purpose carbine ("SPC") and any variants. Suitable changes and modifications for any larger caliber arms (such as 7.62 mm NATO or 0.260 Remington, or 6.5 mm Creedmoor and any variants) should be considered disclosed, but corresponding modifications to barrel extension size may need to be made as applicable.

As shown in FIGS. 2 and 3, a related art barrel extension 50 is formed as an elongated body having a radial outer surface 63 and extending along a first central axis 90. In the M4/M16 architecture, the diameter of radial surface 63 is typically about 0.994 to 0.999" inches and is configured to be received within a receiver opening (e.g., an opening in receiver 34 in FIG. 1) that is between about 0.998 and 1.006" inches. The barrel extension 50 may have an inner opening 73 (FIG. 2) extending from a barrel interface end to bolt receiving end. This inner opening may be configured to receive a cartridge with a rim diameter of about 0.375 to 0.425" inches. In the case of tapered wall cartridges, the cartridge body may have a rim diameter from about 0.376 to 0.425" inches maximum and about 0.334 to 0.405" inches minimum. If the aforementioned cartridge sizes are used, the inner diameter or twice distance R1 will generally be about 0.572 to 0.577" inches. The barrel receiving end includes an inner radial surface 95 configured to receive a barrel (e.g., barrel 24 in FIG. 1). While not shown in FIG. 3, the inner radial surface 95 is generally threaded and configured to receive corresponding threads of the barrel. The barrel extension further includes a flange 75 near the barrel interface end.

The related art barrel extension further includes a series of lugs 59. It is noted that, while only a single lug 59 is labeled in FIG. 2 and only 3 lugs are labeled in FIG. 3 to prevent obstruction of additional aspects of the barrel extension 50, as shown in FIG. 3, the barrel extension 50 may for example include a series of five lugs that are identical or similar in dimension with bolt lug receiving openings 93 therebetween that are configure to receive a series of bolt lugs (not shown). Each one of the five lugs extend inward toward the first central axis 90 and have a radial inner surface 75, which is a distance R1 from the first central axis 90. In addition, the barrel extension 50 includes a first feed ramp 79 and a second feed ramp 71 for feeding a cartridge or series of cartridges, for example from a magazine (e.g., magazine 20 shown in FIG. 1). In operation, the first feed ramp 79 and the second feed ramp 71 feed individual cartridges from both sides of a magazine (e.g., when cartridges are not oriented vertically in a single column in the magazine and are instead oriented side-by-side or partially side-by-side). The first and second feed ramps 79 and 71 are adjacent a respective first feed ramp lug 99 (FIGS. 2 and 3) and second feed ramp lug 91 (FIG. 2). The first feed ramp lug 99 and second feed ramp lug 91 are similar in shape to lugs 59 but with a section removed to form a section of the first feed ramp 79 and second feed ramp 71. The first feed ramp 79 and second feed ramp 71 have a feed ramp divider 77 therebetween, and the first feed ramp 79, second feed ramp 71, and ramp divider define a ramp width 83. The feed ramp divider 77 includes a feed ramp divider first wall 77*a* and a feed ramp divider second wall 77*b*. As shown in FIG. 3, the feed ramp divider first wall 77*a* forms a flat face approximately ninety degrees or perpendicular to first central axis 90.

The Inventor observed that the related art barrel extension ninety degree first wall 77*a* on the outermost diameter of that portion adjacent to or near the first feed ramp 79 and second feed ramp 71 at times causes various feeding problems and reductions in efficiency and reliability. The second wall 77*b* in the related art sometimes, for example, has a 45 degree counter bore with relation to the central axis 90 that is at the same angle as the front faces of lugs 59. As shown in FIG. 2, the second wall may form a triangle-like wall which is a useful reference point. As described in further detail below, one aspect of the disclosure provides for a reduction or elimination of the first wall 77*a* or the area beneath the triangle-like second wall 77*b* to the greatest extent possible, while still providing adequate support structure behind the feed ramp divider 77.

As shown in FIGS. 2 and 3, the feed ramp divider 77 includes an inner surface 77*c* (FIG. 3) that is the same or substantially the same distance R1 from the first central axis 90 than the radial inner surface 75 of each one of lugs 59. Further, in the related art barrel extension, there is very little radius or chamfer found on any of the internal edges or corners of the barrel extension, with the exception of minor edge breaks from tumbling or deburring the component after machining.

Figure 4:
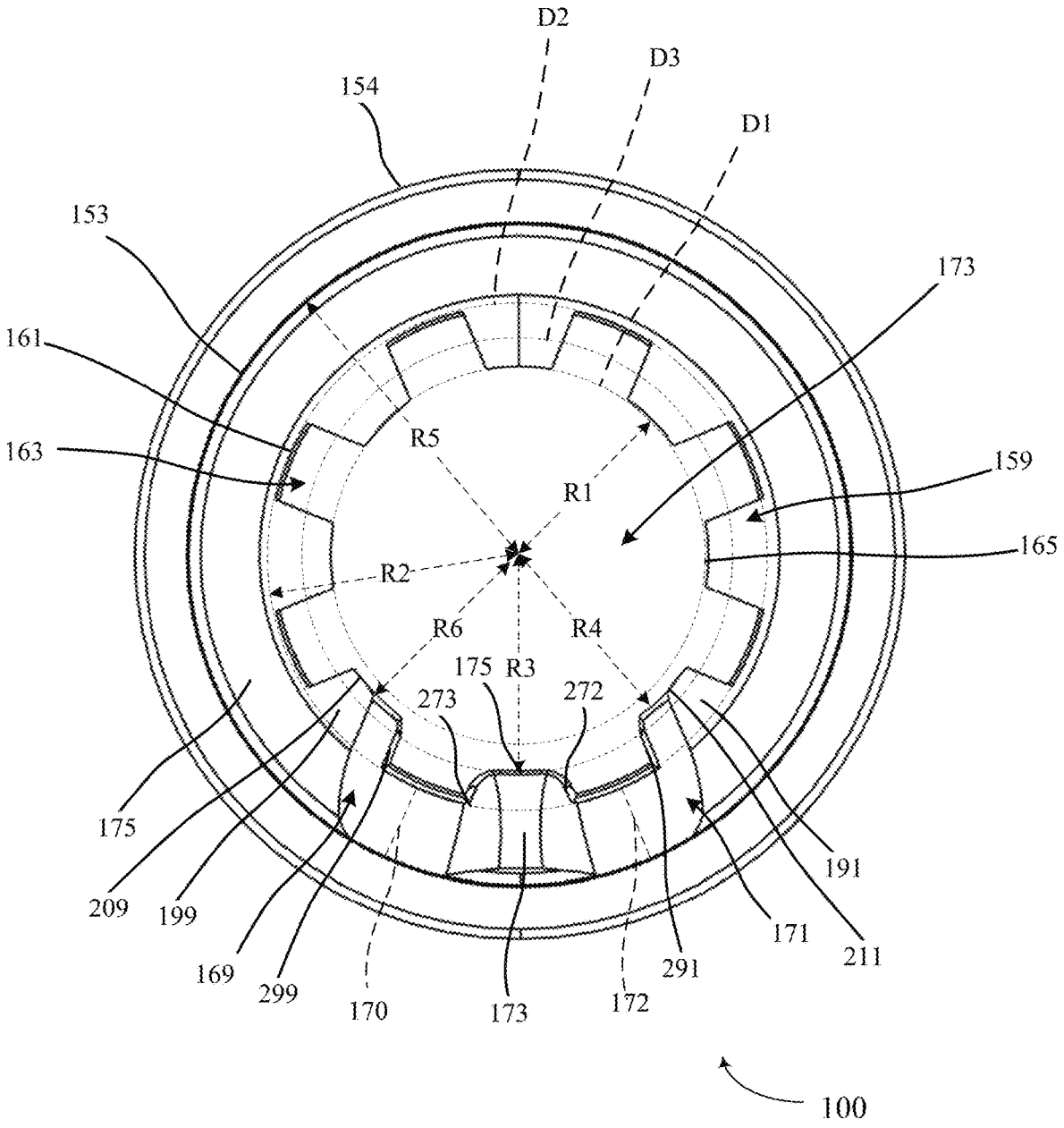
FIG. 4 is a rear view of an example barrel extension in accordance with one aspect of the disclosure.
Figure 5:
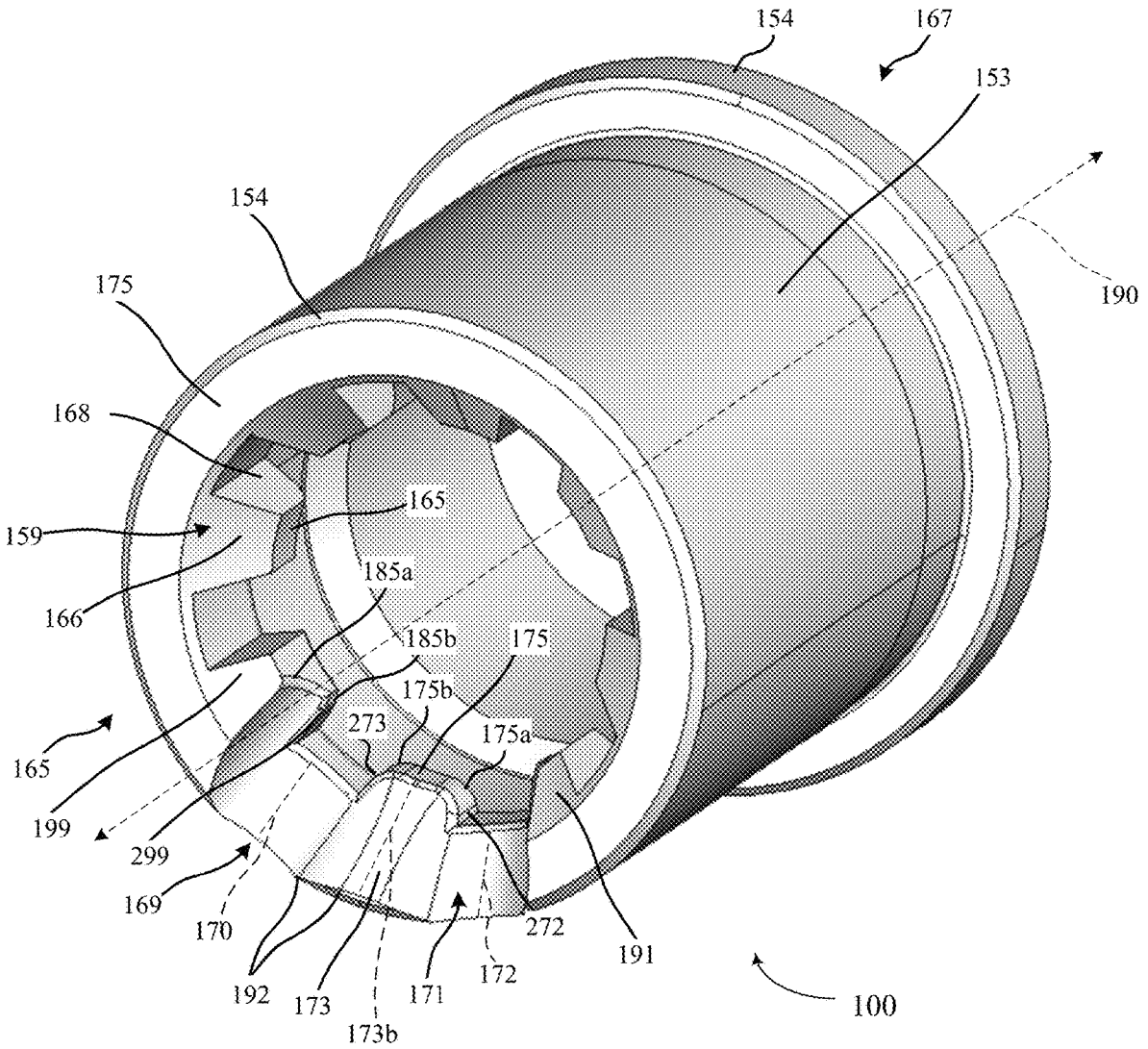
FIG. 5 is a right side perspective view of the example barrel extension of FIG. 4 in accordance with one aspect of the disclosure.
Figure 6:
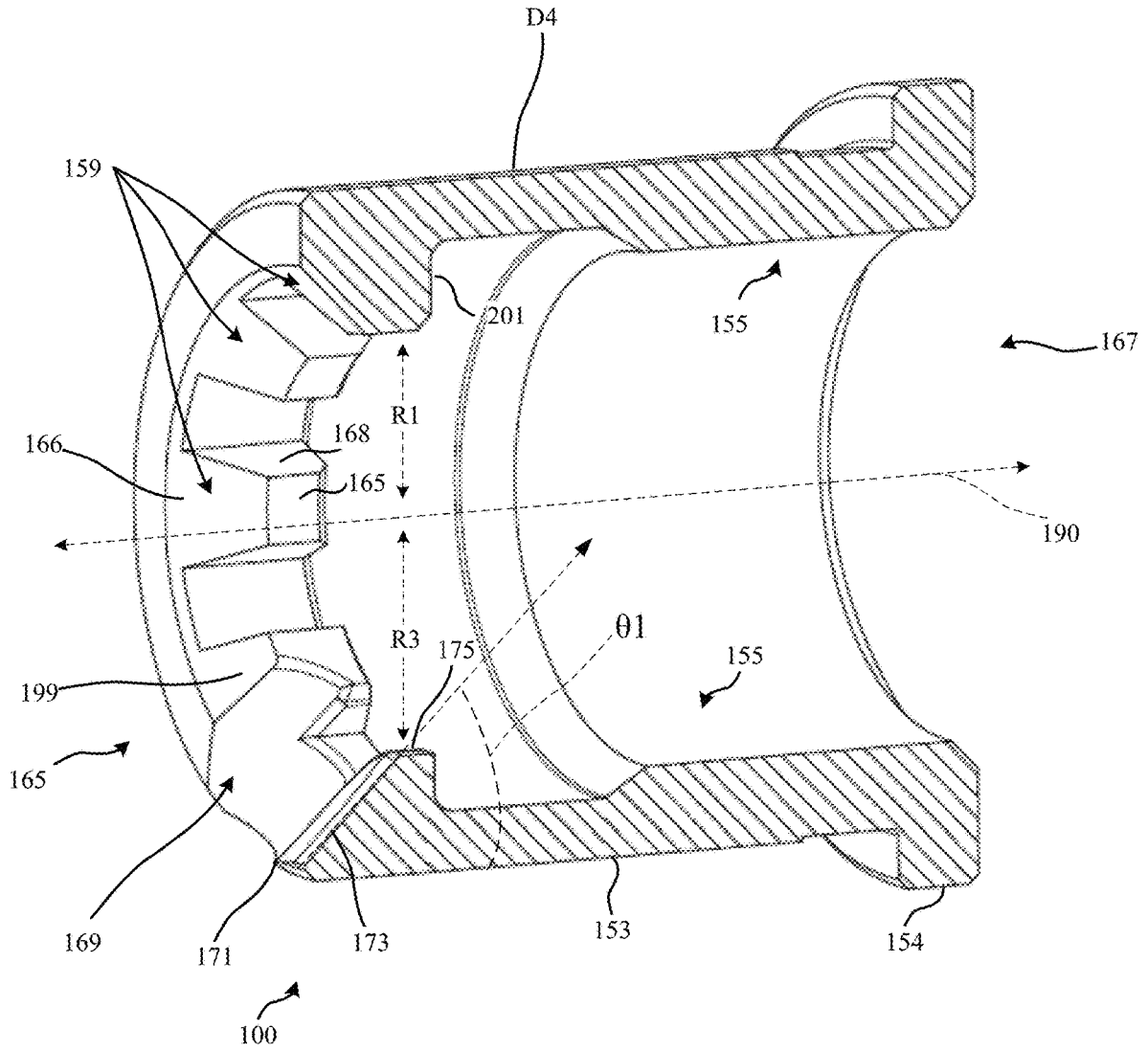
FIG. 6 is a right side perspective section view of the example barrel extension of FIGS. 4 and 5 in accordance with one aspect of the disclosure.
Figure 7:
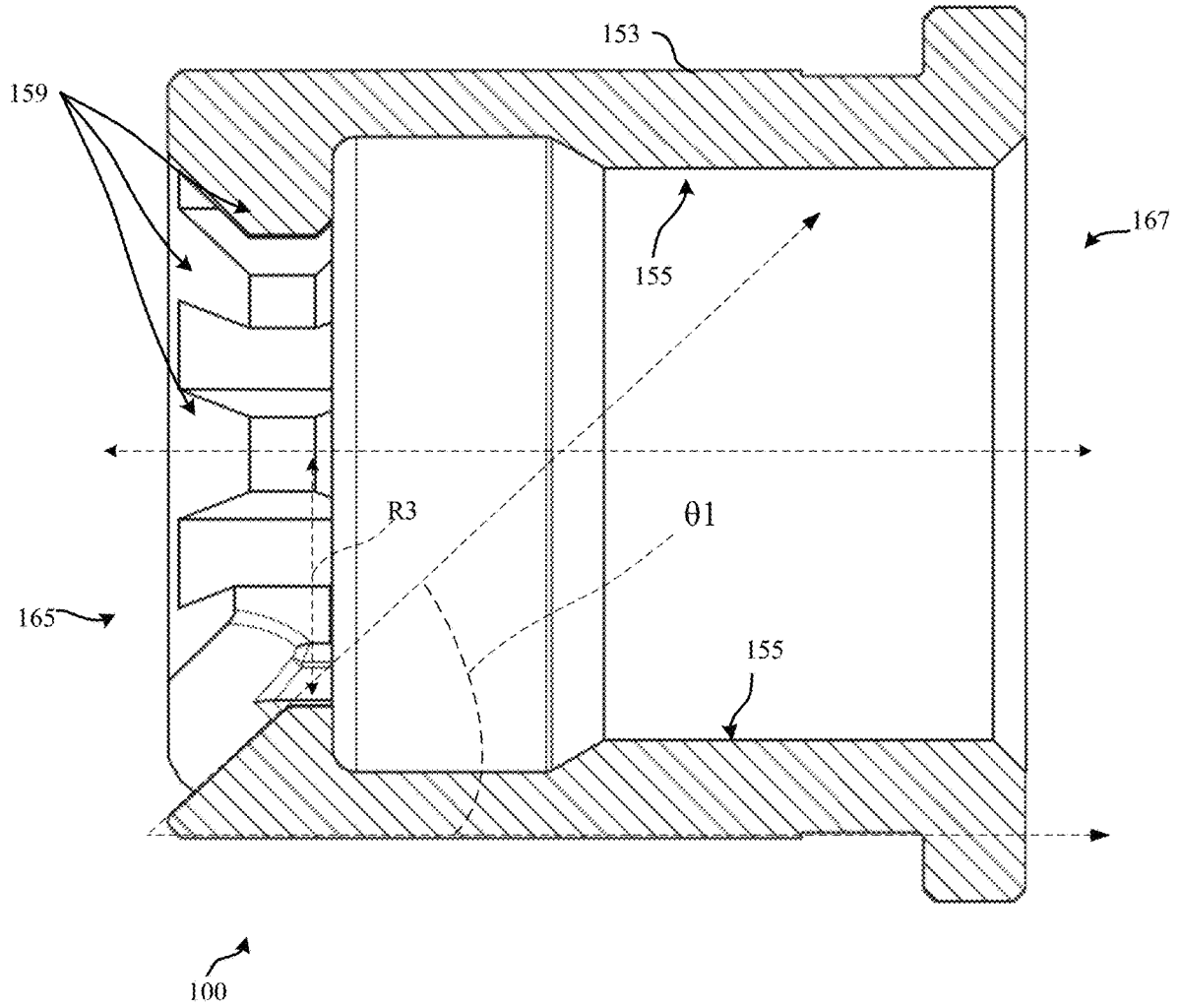
FIG. 7 is a right side section view of the example barrel extension of FIGS. 4-6 in accordance with one aspect of the disclosure.

FIGS. 3-6 show a barrel extension 100 in accordance with aspects of the disclosure. Similarly to the barrel extension 50 in FIGS. 2 and 3, the barrel extension 100 is formed as an elongated body having a radial outer surface 153 and extending along a first central axis 190. In one example usable with the M4/M16 architecture, the diameter of radial surface 153 (e.g., twice a distance R5 shown in FIG. 4) may be about 0.994 to 0.999" inches and may be configured to be received within a receiver opening (e.g., an opening in receiver 56 in FIG. 1) that is between about 0.998 and 1.006" inches. It is noted that, while example dimensions may be provided throughout the disclosure, the example dimensions are not intended to be limiting, and the barrel extension may be modified in dimension to fit any platform and/or receiver opening and/or to be usable with any suitable cartridge size. The barrel extension 100 may further include an inner opening 173 (FIG. 4) extending from a barrel interface end 167 (FIGS. 5-7) to bolt receiving end 165 (FIGS. 5-7). The barrel receiving end includes an inner radial surface 155 (FIGS. 6 and 7) that may be configured to receive a barrel (e.g., barrel 24 in FIG. 1). While not shown in FIGS. 5-7, the inner radial surface 155 may be threaded and configured to receive corresponding threads of the barrel. The barrel extension further may include a flange 154 (FIGS. 4-6) near the barrel interface end 167.

The barrel extension may further includes a series of lugs 159. It is noted that while only a single lug 159 is labeled in FIG. 5 and only 3 lugs are labeled in FIGS. 6 and 7 to prevent obstruction of additional aspects of the barrel extension 100, as shown in FIGS. 4 and 5, the barrel extension 100 may for example include a series of five lugs that are identical or similar in dimension with bolt lug receiving openings 163 therebetween and that are configured to receive a series of bolt lugs (not shown). Each one of the five lugs may extend inward toward the first central axis 190 and have a radial inner surface 165, which may be a distance R1 from the first central axis 190. Thus, as shown in FIG. 4, the radial inner surfaces 165 of lugs 159 may form sections of an inner imaginary circle with a diameter D1. In one example, the inner opening 173 (FIG. 4) may be configured to receive a cartridge with a rim diameter of about 0.375 to 0.425" inches. In the case of tapered wall cartridges, the cartridge body may have a rim diameter from about 0.376 to 0.425" inches maximum and about 0.334 to 0.405" inches minimum, for example. If the aforementioned cartridge sizes are used, a first inner diameter D1 (FIG. 4) or twice distance R1 (FIGS. 4, 6, and 7) may be about 0.572 to 0.577" inches, for example. However, in one aspect of the disclosure, the first inner diameter D1 may be reduced to about 0.560 to 0.574" inches, which the Inventor has observed to reduce recoil and improve consistency of feeding during operation of the M4/M16 platform, for example.

In addition, the barrel extension 100 may include a first feed ramp 169 and a second feed ramp 171 for feeding a cartridge or series of cartridges, for example from a magazine (e.g., magazine 20 shown in FIG. 1). In operation, the first feed ramp 169 and the second feed ramp 171 may feed individual cartridges from both sides of a magazine (e.g., when cartridges are not oriented vertically in a single column within the magazine and are instead oriented side-by-side or partially side-by-side). The first and second feed ramps 169 and 171 may be adjacent a respective first feed ramp lug 199 and second feed ramp lug 191. The first feed ramp lug 199 and second feed ramp lug 191 may be similar in shape to lugs 159 but with a section removed to form a section of the first feed ramp 169 and second feed ramp 171. The first feed ramp 169 and second feed ramp 179 may have a feed ramp divider 173 therebetween.

The feed ramp divider 173 shown in FIGS. 4-6 has been found to provide a significant improvement over the related art barrel extension shown in FIGS. 2 and 3. In one aspect, the reduction of the feed ramp divider 173 provides an increase in feed efficiency and reliability and decreases or eliminates the occurrence of damage to a cartridge being fed into the barrel. As shown in FIGS. 4-7, in one aspect, the feed ramp divider 174 is formed as a contoured surface that further forms a section of the first feed ramp 169 and the second feed ramp 171. The feed ramp divider 174 may further include a feed ramp divider inner surface 175 and chamfered or radiused side surfaces 175*a* and 175*b*. Side surfaces 175*a* and 175*b* may be chamfered or otherwise radiused by at least 0.008-0.012" inches, and preferably 0.010-0.015" inches, and more preferably 0.015-0.020" inches, even more preferably 0.020-0.035" inches or more.

As shown in FIGS. 4 and 6, the feed ramp divider inner surface 175 may, for example, be located a distance R3 from the first central axis 190 of the barrel extension 100. As shown in FIG. 4, the feed ramp divider inner surface 175 may intersect or otherwise have a dimension or dimensions that follow an imaginary circle having a diameter twice a distance R3 and having a diameter D3. When compared to the distance R1 from the central axis 190 to the inner surface of lugs 159, distance R1 may be less that distance R3.

As shown in FIG. 4, lugs 159 may have bolt lug receiving openings 163 therebetween, and the bolt lug receiving openings may further include a receiving opening inner surface 161. Each of the receiving opening inner surfaces may be located a distance R2 (FIG. 4) from central axis 190 of the barrel extension 100. Each of the bolt lug receiving openings 163 may intersect or otherwise have a dimension or dimensions that follow an imaginary circle having a dimeter twice a distance R2 and having a diameter D2. In one aspect the following inequality between distances R1, R2 and R3 may be satisfied: R1<R3<R2.

The first feed ramp lug 199 may further include a first feed ramp lug side surface 299. Further, the ramp divider 173 may further include a first side surface 273. As shown in FIGS. 4 and 5, the first feed ramp lug side surface 299 and the first side surface 273 may be substantially parallel at location R2 with respect to the central axis 190. Further, the first feed ramp lug side surface 299 and the first side surface 273 may widen and form non-parallel surfaces at second location that is more proximal to the central axis 190. The aforementioned widening may be due to a chamfered or radiused surface 185*b* (FIG. 5) and/or 175*b*. Similarly the second feed ramp lug 191 may further include a second feed ramp lug side surface 291. Further, the ramp divider 175 may further include a second side surface 272. As shown in FIGS. 4 and 5, the second feed ramp lug side surface 291 and the second side surface 272 may be substantially parallel at location R2 with respect to the central axis 190. Further, the first feed ramp lug side surface 291 and the first side surface 272 may widen and form non-parallel surfaces at second location that is more proximal to the central axis 190. The aforementioned widening may be due to a chamfered or radiused surface 175*a* (FIG. 5) and/or a similar chamfered or radiused edge on the second feed ramp side lug 191 (hidden from view, but similar to 175*b* on the first feed ramp lug 199). It is noted that in the aforementioned examples, along with the other examples disclosed throughout the specification, any on or a combination of lug inner surface 165, divider inner surface 175, and/or the first feed ramp lug inner surface 209, or second feed ramp lug inner surface 211 may be located the same distance from the central axis 190 of the barrel extension.

While the improvements described below are related to changes in the height and/or shape of the ramp divider 173, aspects of the disclosure may also be related to the further elimination or reduction of the feed ramp divider first wall 77*a* (FIGS. 2 and 3), as well as reducing the overall mass of the protuberance thereof, and/or reducing the complexity of the geometry and multiple "sharp" surfaces that the cartridge case may be slowed or stopped by. For example each lug 159 may have a counter bore surface 166 (FIG. 5), a side wall 168 and the aforementioned inner surface 165. While not shown in the figures, in one aspect, the edges where counter bore surface 166 (FIG. 5), a side wall 168 and the aforementioned inner surface 165 meet may be chamfered or otherwise radiused by at least 0.008-0.012" inches, and preferably 0.010-0.015" inches, and more preferably 0.015-0.020" inches, even more preferably 0.020-0.035" inches or more.

Removal of or reduction of the feed ramp divider first wall 77*a* (FIGS. 2 and 3), which as described above with reference to FIGS. 2 and 3, forms a wall face that is approximately ninety degrees or perpendicular to the first axis 90 (FIGS. 2 and 3) in the related art, removes and/or decreases a significant obstacle for cartridges to travel over in the feeding process—where the cartridge goes from feeding device, such as a belt with machine guns or magazine with carbines or rifles or certain machine guns—and reduces the occurrence of stoppages caused by a failure to feed, for example. A failure to feed refers to the round or cartridge failing to successfully move from the feeding device into the chamber in preparation for firing. Ideally the feed ramp divider 173 is reduced in profile and retained to some degree in order to help align and better feed cartridges—however, in some aspects the feed ramp divider 173 may also be eliminated entirely.

In one example aspect of the disclosure, the feed ramp divider 173 is angled and has a ramp divider surface that is contoured and spans from the first feed ramp 169 to the second feed ramp 171. As shown in FIGS. 6 and 7, the central portion of ramp divider 173 (e.g., at imaginary line 173 in FIG. 5) may form an angle θ1 with respect to radial outer surface 153. In one aspect, the angle θ1 may be between 25 degrees and 50 degrees, or more preferably between 35 degrees and 47 degrees. Further, the feed ramp divider surface 173 may meet the radial outer surface 153 at an edge 192. In one aspect, the feed ramp divider surface 173 may be proximal to the radial outer surface 153. In any one or a combination of the aforementioned examples, the ramp divider surface 173 may form an oblique angle with respect to the radial outer surface 153 at edge 192.

Thus a feed ramp divider 173 that has the initial ramp closer to the OD than currently placed is disclosed. The start of the ramp from less than about 0.080-0.105" from the OD is possible, the start of the ramp less than about 0.060-0.085" from the OD is preferable, the start of the ramp less than about 0.040-0.065" from the OD is more preferable, the start of the ramp less than about 0.020-0.045" from the OD is even more preferable, and the start of the ramp less than about 0.001-0.035" from the OD is most preferable.

The distance between the barrel extension face 175 and the rear engagement surface 201 (FIG. 6) where the Bolt Lugs lock into battery against the lugs 159 of the barrel extension is typically about 0.216" (plus or minus minor tolerance of about 0.002") in length, which may be interchangeably referred to as the lug length.

A significant portion of the lug length in the related art barrel extension is not used to help ease the vertical transition of the cartridge from the feeding device into the chamber, and thus the aforementioned aspects may be implemented without removal of excessive material or notable reduction of strength of the lugs.

The aforementioned aspects, allow for the use of more than ⅓ of the Lug Length for the initial ramp when considered in a straight line travel perspective, and less than ⅔ of the space is unused for assisting in the cartridge transition of climb. This approach greatly promotes straight line like performance. Straight line feed or performance occurs where there is very little vertical separation between the feed device (typically a box magazine) and the chamber or barrel.

The disclosed sample feed ramp divider 173 of the improved barrel extension has a much lower initial feed ramp start (thus reduction in actual or effective ninety degree wall or face height compared to the first wall 77*a* in FIG. 2, (which in current M4/M16 barrel extensions is about 0.103-0.110" inches) when measured from the radial outer surface 63, which may hereinafter be interchangeably referred to as the OD (less than about 0.035"-0.050" as shown, although any reduction is disclosed) and has a somewhat lowered lug height (by about 0.020-0.030" inches for example, though any reduction is disclosed) which produces a ramp angle of less than 45 degrees and a ramp length from bottom end to top end which is not only more than about half of the lug length but not only equal to the lug length (about 0.216" inches long from face to lug interface area) but is longer by about 10-14%, and optimally less than about 10-30% of the lug length is used for space that does not assist with cartridge climb. With user of stronger materials and optimal engineering, further reductions (less than 5-15% or less) of the lug length may be used for assisting with cartridge climb. Among other advantages, this approach serves to greatly facilitate cartridge transition and feeding over current M4 and M16 barrel extensions.

In one aspect of the disclosure, the first feed ramp 169 and second feed ramp 171 may include a scalloped or otherwise rounded or partially concave surface. The first and second feed ramps 169 and 171 may include a ramp angle that is measured along an imaginary center line (e.g., first center line 170 and second center line 172). The ramp angles of the first and second feed ramps 170 and 171 may form an angle of less than 53 degrees with respect to radial outer surface 153. In another aspect, an angle between the radial outer surface 153 and the first and/or second feed ramps 170 and 171 may be between 45 degrees and 50 degrees, or between 39 and 40 degrees.

As shown in FIG. 4, the first and second feed ramps 169 and 171 may be adjacent or proximal to a respective first feed ramp lug 199 and second feed ramp lug 191. The first feed ramp lug 199 and second feed ramp lug 191 may be similar in shape to lugs 159, but with a section removed to form a section of the first feed ramp 179 and second feed ramp 171. In another aspect, the first feed ramp lug 199 and second feed ramp lug 191 may have inner surfaces 209 and 211. The inner surfaces may be located a distance R6 from the center axis 190 of the barrel extension 100. In one example, distance R6 may be less than distance R3 and greater than distance R1.

In another aspect, the first and second feed ramp lugs 199 and 191 may include a chamfered or radiused section 185*a* and/or 185*b*. By adding a chamfer or radius, feed reliability and cycling efficiency may be increased, and the occurrence of damage to the cartridge may be decreased or eliminated. In one aspect, the chamfer or radiused section 185*a* and/or 185*b* may have a radius of about at least 0.008-0.012", and preferably 0.010-0.015", more preferably 0.015-0.020", and even more preferably 0.020-0.035" or more; however, the use of the largest radius or chamfer is most preferable in some implementations. As shown in FIG. 5, edge 185*b* may or include be a blended corner as shown and may be chamfered or blended at approximately 45 degrees. It is noted that the aforementioned aspect is only an example, and the chamfer or blending at any of the edges may be applicable to any edge or corner within the barrel extension 100.

Amongst other advantages, reducing aspects of the feed ramp of the current disclosure provide significantly improved compatibility with various rounds and various platforms. This approach provides improvements, among other things, with regard to one current problem caused by the current M4 (and M16, etc.) barrel extension, which causes rounds to feed at a much higher angle than possible and when M855 A1 (e.g., current army service rounds) ammunition is used this leads to significant "scoring" (effectively digging a small channel) of the chamber for up to well more than half of the length of the chamber. With the A1 ammo being used on a widespread basis across hundreds of thousands of weapons, this issue creates an immense logistical burden. The Improved barrel extension effectively eliminates or reduces this problem, thus easing logistical problems and creating more reliable feeding, among other advantages.

The improved feed ramp divider 173 geometry as described and shown helps enable the successful integration of wider first and/or second feed ramps 170 and/or 171 and the most free flowing, low drag feeding environment possible.

The techniques and methods described in this document for the feed ramp divider 173 may also be applied as applicable to any other barrel extension Lugs and should be considered disclosed for those as well.

While a number of example aspects and aspects have been discussed above, those of skill in the art will recognize that still further modifications, permutations, additions and sub-combinations thereof of the features of the disclosed aspects are still possible. It is therefore intended that the following appended claims and claims hereafter introduced are interpreted to include all such modifications, permutations, additions and sub-combinations as are within their true spirit and scope.

Reduced Lug Height

In one aspect, the lug height of the barrel extension may be reduced to less than about 0.124-0.129" inches when compared to the base of the 0.830" diameter of the area that the bolt lugs rotate within the barrel extension when locking and unlocking. When compared to the BBL EXT lug "gap" (the square area between the lugs that the bolt lugs pass through during locking and unlocking) between the BBL EXT lugs, the lug height may also be reduced from approximately 0.093-0.094" inches to less than this amount. The shorter lug height may result in a less abrupt "climb" needed when the cartridge is feed and feeding of the cartridges can be closer to a straight line with the barrel. The reduced lug height and refined geometry and optimized geometry may produce a much smoother and more easily transited surface for the cartridge to move from the feeding device into the chamber. Aspects may include an M4 barrel extension that may have a feed ramp angle of about 44 degrees while maintaining full compatibility with all components and architecture. The ramp divider may also have the same angle in some aspects. In one aspect of the disclosure, the BBL EXT may not expose the M4 receiver to impact due to the aforementioned aspects and it does not expose the cartridge to any gaps between the receiver or barrel extension which may impede feeding or reliable operation.

The use of wider feed ramps than about 0.250-0.275", and preferably about 0.275-0.300", and more preferably about 0.300-0.325", and most preferably about 0.325-0.375" or more is disclosed. This enables the cartridge case itself, including the body, to more easily transit this area whereas the current dimensions focus on the bullet or projectile diameter (about 0.223" diameter) or the case neck (case area around the bullet which is about 0.250"). Additional improvements to the feed ramp size are described above. The feed ramps can be optimized by restructuring the ramp divider as described.

The lug gap or distance between the BBL EXT lug openings (shown as a squared shape on the M4 BBL EXT) may also be increased to beyond 0.127" inches, especially in the upper areas of the lugs, towards the top described previously. The ninety degree walls which define the sides should move away from one another via any suitable technique such as chamfering, applied radii, etc. This aspect may enable the narrowest point of the lugs which abut the current feed ramps to be greater than the current width of about 0.330-335" inches, which serves as a "choke point" which the cartridges must transit through. Increasing this area beyond 0.335" inches to the maximum extent possible, for example to 0.355" inches or about 0.400-0.450" inches or more may provide additional advantages.

Rise/Run

In one aspect, the lug height may be shortened which can reduce the height of the lugs adjacent to the feed ramp(s), and it may reduce the other lug height as well to permit the use of a larger, more robust Bolt. Using the maximum amount or percentage possible of the Lug for "ramp area"—as measured from front—where the Barrel Extension Lugs engage the Bolt Lugs when locked in battery- to the back area where the Barrel Extension ends at the junction of the Upper Receiver-enables the effective "run" length to be increased or lengthened.

A ramp area other than that pertaining specifically to the feed ramps and the ramp divider area between the feed ramps. In one aspect, the 45 degree cut may extend past the face of the BBL EXT by more than about 0.108" inches when measured along the bore axis. In the aforementioned aspect, this represents about half the possible lug thickness. Thus using an amount of the possible lug thickness that is more than about half of the possible distance is disclosed. Or using more than about 0.216" inches of lug thickness as defined by the distance from the BBL EXT Face to the engagement area of the lugs where the rearmost portion of the bolt lugs lock into when the firearm or weapon is "in battery." In Battery may denote the bolt being locked into position with a cartridge in the chamber, prepared to fire.

The aforementioned aspects may lessen any angular obstacle that the cartridge must overcome by lessening or decreasing the angle from 45 degrees on both the M4 and M16 BBL EXT to less than 45 degrees—or put another way more in line with the bore axis and chamber. By decreasing the angle from 45 degrees, presuming no other changes, the "flat" portion of the BBL EXT lug—the area between the lug gaps (which allow the bolt lugs to pass through when going into and out of battery during feeding and extraction) may be shortened from about 0.086"–0.088" inches to less than this amount. The remainder of the dimension may be taken by an inner chamfer of about 0.020-0.022" inches, which is at the intersection of the flat portion and the BBL EXT lug/bolt lug engagement surface.

If the BBL EXT lug height is reduced by increasing the inner diameter to greater than about 0.577" inches, then the BBL EXT Lug "Flat" may enlarge or grow due to the angular nature of this assembly.

Increased "run" length and decreased rise" height may create the smoothest possible feeding of the cartridge that is closer to a straight line feeding (which creates the least possible climb or climb angle possible for the cartridge). The more straight line feeding created by this combination of changes may be advantageous and improve efficiency and constancy of the firearm. The aforementioned aspects may be especially helpful when using the new US service round—known as the M855A1 ("A1"). The A1 round has an exposed hardened steel penetrator at the end or tip of the bullet. It is designed to penetrate armor plate, and is extremely hard. The feed angle created by the Barrel Extension previously was not especially problematic with service rounds (M193FM—full metal jacket, and M855 Green Tip—steel core) because they had fairly soft jackets and would not damage the chamber when they made contact during feeding. The A1 round with the exposed hard steel penetrator digs a groove in the chamber with current Barrel Extensions. This groove becomes bigger as more rounds are fired. Ultimately this groove becomes large enough that the case, made of brass, swells or obdurate under pressure and may become stuck in the groove. This can create malfunctions or even catastrophic damage—and may also wear the chamber out before the barrel is worn out. Using straight line type feeding—which is closer to alignment with the bore of the barrel—not only provides feeding that is easier and more reliable, but the cartridge tip impact with the chamber is significantly reduced or eliminated. The measurements described may be applicable to a BBL EXT with an outer diameter (OD) of about 0.9987" inches and an internal diameter (ID) of about 0.830" that permits turning or rotation of bolt lugs.

Cam Pin

The reduction in material on the cam pin head which comes into contact with the upper receiver is disclosed as a method to promote smoother movement and more reliable operation of the bolt carrier group ("BCG"). The head is the portion atop the cam pin body, or cylinder, that operates within the bolt carrier and resides in the bolt cam pin hole. The body has a hole cut through it that the firing pin passes through.

The cylinder may have one or more recesses cut or disposed within the body to decrease the contact area to the cam path of the bolt carrier, and also provide a location for debris such as sand or firing fouling to accumulate without hindering movement of the cam pin.

Reduced outer contact height—top to bottom of contact area—less than about 0.085-0.095" (about 0.090-0.100") as standard TDP dimension reduces the drag or resistance created by the cam pin.

Reduced outer contact length—front to rear of contact area—reduced contact surface as measured from front to rear.

Cam Path

In addition to numerous improvements to the cam path previously made, the increase in the turn rate, or rotational rate of the bolt rotation in the first and second degree is disclosed. Currently, the rotation or turn from fully locked (22.5 degrees) to 1 degree of unlocking takes about 0.111" of space, including locked dwell, on the standard cam path as defined in the technical data package ("TDP"). This is of about 0.325" of available space, or about 34.15% of all space to rotate the necessary 22.5 degrees to "unlock" of the bolt. This is excessive and creates the most movement when the fired cartridge is at maximum pressure—immediately after firing.

The author proposes and discloses using less than this or about 34% of available space in unlocking the bolt in this first degree of movement.

With the standard TDP "locked dwell" (the space provided for back and forth movement with no rotation while the bolt is fully locked in battery) of 0.070", combined with the standard first degree of rotation (about 0.041").

This is excessive—for optimal use the author discloses less than this space used for the locked dwell and first degree of movement. That is, less than 0.111", and preferably less than about 0.090-0.110", and more preferably less than about 0.070-0.090", and even more preferably less than about 0.050-0.070" or even less.

This "turns" or rotates the bolt more quickly than is currently done in the TDP dimensions. This provides more optimized unlocking for smoother firing and operation. The first degree of rotational movement (from 22.5 to 21.5 degrees) may take less than about 0.041" of space for optimal use, regardless of any changes to the locked dwell that may be considered.

The second degree of rotation (from 21.5-20.5 degrees) uses about 0.014" of distance per the TDP dimensions. This may be left as is, or it may be decreased (more than about 0.014" of space for this degree of turn) or it may be increased in turn rate (less than about 0.014" of space for this degree of turn) as desired.

The space saved on the first (and/or second) degree of rotation may be applied throughout the entire range of locking/unlocking to help provide maximum smoothness and reliability.

This may be added to the unlocked dwell and first degree of rotational movement as described above for optimal operation.

The remainder of the turn rate or rotation of the bolt may be maintained as is per TDP, or it may be increased or decreased as applicable.

These too may be added (or not) to the unlocked dwell and first degree (and second etc. as desired) of movement as described above for optimal operation.

Bolt

The M4/M16 (and equivalent, adjusted for different calibers and systems as applicable) Bolt uses a chamfer on the rear left edge of the bolt locking lug. This is to provide relief and lessen stresses when the bolt "unlocks" or moves from in battery at firing to out of battery as the fired case is extracted and ejected. The chamfer is about 0.020"×45 degrees per TOP. The Inventor has discovered that by using a radius of similar size in this area—which provides for smoother, less abrupt unlocking than a chamfer offers due to the "falloff" nature of the chamfer in clearing the BBL EXT lugs. The radius method provides a smoother "rolling" unloading in comparison. Additionally the radius method, instead of a chamfer, serves to keep the Bolt "locked" after firing albeit by a slight amount. Any gain in keeping the bolt locked longer after firing is extremely desirable due to pressure reductions that take place very quickly after the cartridge is fired.

Using a radius as dictated above is disclosed as an advantageous method to improving operation.

The use of chamfers or radii larger than those specified in the TDP on sharp edges (greater than about 0.010-0.015") is disclosed to help decrease stress buildup in the material, as well as provide increased clearance to parts especially when the bolt lugs are made oversize (greater than about 0.102" width).

This helps increase smoothness to the maximum degree possible when transiting the barrel extension lugs during feeding and extraction.

The invention claimed is:

1. A barrel extension for use with a firearm, the barrel extension comprising:

a barrel extension body extending along a barrel extension central axis between a barrel interface end and a bolt receiving end, wherein the barrel interface end is configured to be connected to a barrel and the bolt receiving end is configured to selectively receive a rotatable bolt of the firearm;

a plurality of barrel extension lugs at the bolt receiving end having bolt lug receiving openings therebetween, wherein each of the plurality of barrel extension lugs has a lug inner surface that is a first distance (R1) from the central axis, and each of the plurality of receiving openings have a receiving opening inner surface that is a second distance (R2) from the central axis;

a first feed ramp with a first feed ramp surface configured to guide a firearm cartridge;

a second feed ramp with a second feed ramp surface configured to guide a firearm cartridge; and a ramp divider between the first feed ramp and the second feed ramp, wherein the ramp divider has a ramp divider inner surface that is a third distance (R3) from the central axis, wherein the inequality R1<R3<R2 is satisfied.

2. The barrel extension of claim 1, wherein the ramp divider has a first side surface and a second side surface, the barrel extension further comprising:

a first feed ramp lug adjacent to the first feed ramp and having a first feed ramp lug inner surface located a third distance from the barrel extension central axis and a first feed ramp side surface, wherein the first side surface and the first feed ramp side surface are parallel at a first portion of the first side surface and a first portion of the first feed ramp side surface and are not parallel at a second portion of the first side surface and the first feed ramp surface, wherein the first portion of the first feed ramp side surface and the first side surface is more distal from the barrel extension central axis than the second portion of the first feed ramp side surface and the first side surface.

3. The barrel extension of claim 2, wherein if the first distance is R1, the second distance is R3, and the third distance is R6, the inequality R1<R6<R3 is satisfied.

4. The barrel extension of claim 1, wherein the R1 is about 0.280 to 0.295" inches.

5. The barrel extension of claim 1, wherein the barrel extension further comprises a radial outer receiver interface surface configured to be at least partially received within a receiver of the firearm, wherein the first feed ramp surfaces and second feed ramp surfaces intersect with the radial outer receiver surface.

6. The barrel extension of claim 1, further comprising:

a barrel extension body having a radial outer surface and extending along a barrel extension central axis between a barrel interface end and a bolt receiving end, wherein the first feed ramp comprises a first feed ramp surface that intersects the radial outer surface of the barrel extension, and wherein the second feed ramp comprises a second feed ramp surface that intersects the radial outer surface of the barrel extension.

7. The barrel extension of claim 6, wherein an angle between the radial outer surface and the first feed ramp surface is less than 53 degrees.

8. The barrel extension of claim 6, wherein an angle between the radial outer surface and the first feed ramp surface is between 39 degrees and 52 degrees.

9. The barrel extension of claim 6, wherein an angle between the radial outer surface and the second feed ramp surface is less than 53 degrees.

10. The barrel extension of claim 9, wherein an angle between the radial outer surface and the second feed ramp surface is between 39 degrees and 50 degrees.

11. A firearm comprising:

a barrel;

a barrel extension body extending along a barrel extension central axis between a barrel interface end and a bolt receiving end, wherein the barrel interface end is configured to be connected to the barrel and the bolt receiving end is configured to selectively receive a rotatable bolt of the firearm;

a plurality of barrel extension lugs at the bolt receiving end having bolt lug receiving openings therebetween, wherein each of the plurality of barrel extension lugs has a lug inner surface that is a first distance from the central axis, and each of the plurality of receiving openings have a receiving opening inner surface that is a second distance from the central axis;

a first feed ramp with a first feed ramp surface configured to guide a firearm cartridge;

a second feed ramp with a second feed ramp surface configured to guide a firearm cartridge;

a ramp divider between the first feed ramp and the second feed ramp, wherein the ramp divider has a ramp divider inner surface that is a third distance from the central axis and a first side surface and a second side surface; and a first feed ramp lug adjacent to the first feed ramp and having a first feed ramp lug inner surface located a third distance from the barrel extension central axis and a first feed ramp side surface, wherein the first side surface and the first feed ramp side surface are parallel at a first portion of the first side surface and a first portion of the first feed ramp side surface and are not parallel at a second portion of the first side surface and the first feed ramp surface, wherein the first portion of the first feed ramp side surface and the first side surface is more distal from the barrel extension central axis than the second portion of the first feed ramp side surface and the first side surface.

12. The firearm of claim 11, wherein the first distance and third distance are substantially the same.

13. The firearm of claim 11, wherein if the first distance is R1, the second distance is R2, and the third distance R3, the inequality R1<R3<R2 is satisfied.

14. The firearm of claim 11, wherein if the first distance is R1, the second distance is R3, and the third distance is R6, the inequality R1<R6<R3 is satisfied.

15. The firearm of claim 11, wherein the R1 is about 0.280 to 0.295" inches.

16. A barrel extension for use with a firearm, the barrel extension comprising:

a barrel extension body having a radial outer surface and extending along a barrel extension central axis between a barrel interface end and a bolt receiving end, wherein the barrel interface end is configured to be connected to a barrel and the bolt receiving end is configured to selectively receive a rotatable bolt of the firearm;

a plurality of barrel extension lugs at the bolt receiving end having bolt lug receiving openings therebetween;

a first feed ramp with a first feed ramp surface configured to guide a firearm cartridge;

a second feed ramp with a second feed ramp surface configured to guide a firearm cartridge; and an angled ramp divider between the first feed ramp and the second feed ramp having a ramp divider surface, wherein at least a portion of the ramp divider surface meets the outer radial surface at a ramp divider edge, and wherein the at least a portion of the ramp divider is oblique with respect to the radial outer surface at the edge.

17. The barrel extension of claim 16, wherein the first feed ramp surfaces and second feed ramp surfaces intersect with the radial outer receiver surface.

18. The barrel extension of claim 6, wherein an angle between the radial outer surface and the first feed ramp surface is less than 53 degrees.

19. The barrel extension of claim 6, wherein an angle between the radial outer surface and the first feed ramp surface is between 39 degrees and 52 degrees.

* * * * *